US005743771A

United States Patent [19]

Yamaguchi et al.

[11] Patent Number: 5,743,771

[45] Date of Patent: Apr. 28, 1998

[54] TERMINAL FOR ELECTRICAL CONNECTOR

[75] Inventors: Noboru Yamaguchi; Masaya Yamamoto, both of Shizuoka-ken, Japan

[73] Assignee: Yazaki Corporation, Tokyo, Japan

[21] Appl. No.: 720,068

[22] Filed: Sep. 27, 1996

[30] Foreign Application Priority Data

Sep. 29, 1995 [JP] Japan ..... 7-253426

[51] Int. Cl.[6] ..... H01R 13/42

[52] U.S. Cl. ..... 439/752.5

[58] Field of Search ..... 439/752.5, 752, 439/862

[56] References Cited

U.S. PATENT DOCUMENTS

| | | | |
|---|---|---|---|
| 5,478,263 | 12/1995 | Kato | 439/752 |
| 5,516,308 | 5/1996 | Yamanashi | 439/752 |
| 5,554,052 | 9/1996 | Saijo et al. | 439/752.5 |
| 5,595,509 | 1/1997 | Fry et al. | 439/752 |

*Primary Examiner*—Gary F. Paumen

*Attorney, Agent, or Firm*—Finnegan, Henderson, Farabow, Garrett & Dunner, L.L.P.

[57] ABSTRACT

A terminal for an electrical connector comprises a terminal body section 11 which is formed in such a way that a metallic plate material is bent to be shaped at least in semi-cylindrical shape, an elastic contact piece which is protruded in the outside direction of a front section of the terminal body section 11, coming into contact with an inner peripheral wall of a terminal insertion hole when the terminal body section 11 is inserted into the terminal insertion hole of a connector housing from a pointed end of a front section thereof, and a wrong-insertion prohibiting piece which is provided to be projected at a bottom wall 11*a* of the terminal body section 11, being positioned at opposite side of the elastic contact piece for preventing the terminal from inserting into the terminal insertion hole due to precluding of the wrong-insertion prohibiting piece toward the connector housing when the terminal body section 11 is inserted into the terminal insertion hole in the inverse direction. The slitting-and-forming pieces are provided at positions to be shifted in the longitudinal direction on both end edges of the width direction of said bottom wall of the terminal body section 11, so that two pieces of the slitting-and-forming pieces are brought into two pieces of the wrong-insertion prohibiting piece 15.

5 Claims, 5 Drawing Sheets

TERMINAL FOR ELECTRICAL CONNECTOR

BACKGROUND OF THE INVENTION

1. Field of the Invention

The present invention relates to a terminal for an electrical connector in which, when inserting a terminal into a terminal insertion hole of a connector housing in the inverse direction, a wrong-insertion prohibiting piece of the terminal precludes the terminal from inserting into the terminal insertion hole of the connector housing.

2. Description of the Related Art

When the conventional box type terminal is employed, since an elastic contact piece which is connected to a male terminal of an opposite connector is accommodated on the inside of a box-type terminal body section, the elastic contact piece is not deformed by only contact to a peripheral wall of the terminal insertion hole of the connector housing. Consequently, since the terminal body section does not upset the balance within the terminal insertion hole, the inverse insertion of the terminal is capable of being surely prevented by providing only one wrong-insertion prohibiting piece which prevents the terminal from inserting into the terminal insertion hole because the wrong-insertion prohibiting piece precludes the terminal from inserting into the connector housing in case of inverse insertion.

However, for the terminal in which the elastic contact piece projects toward the out side direction of the terminal body section, when inserting the terminal into the terminal insertion hole of the connector housing, the elastic contact piece comes into contact to be deformed with the peripheral wall of the terminal insertion hole, so that the terminal body section may upset the balance to be inclined in the terminal insertion hole. In such the case, the wrong-insertion prohibiting piece can not surely preclude the terminal from inserting into the connector housing by providing only one wrong-insertion prohibiting piece, with the result that the inverse insertion is incapable of being prevented substantially.

SUMMARY OF THE INVENTION

In view of the foregoing, it is an object of the present invention to provide a terminal for an electrical connector which can surely prevent the terminal from inverse insertion.

According to one aspect of the present invention, for achieving the above-mentioned object, there is provided a terminal for an electrical connector comprising a terminal body section provided by bending a metallic plate material in semi-cylindrical shape, an elastic contact piece formed so as to protrude from a front section of the terminal body section, to the outside and two wrong-insertion prohibiting pieces which is formed so as to project from a bottom wall of the terminal body section to a direction opposite to the elastic contact piece the two wrong insertion prohibiting pieces being arranged on both edges of the bottom wall in a width direction of the terminal body respectively and shifted from each other in a longitudinal direction of the terminal body section, wherein the two wrong insertion prohibiting pieces are provided by slitting the bottom wall of the terminal body section partially and raising the two resultant sections in a direction perpendicular to the bottom wall.

As stated above, in the terminal for the electrical connector, the two wrong-insertion prohibiting pieces are so provided that these are shifted in the lengthwise direction with slitting and forming. The strength of the terminal body section is held. No difficulties on processing arise. A protruded height from the bottom wall on both wrong-insertion prohibiting pieces can be established to the extent of whole width maximum of the bottom wall. Incidentally, if the wrong-insertion prohibiting piece is formed by slitting to the position exceeding the end edge in the width direction of the bottom wall, the protruded height becomes large, however, the strength of the terminal body section deteriorates, also the pressing procession becomes complicated. On the other hand according to the present invention, the two inverse insertion preventing pieces with large height are provided on both end edges of the bottom wall with good balanced condition. For this reason, a large precluding margin can be obtained without upsetting the balance in case of inverse insertion. As a result, even if the elastic contact piece is bent to some extent at the time of inverse insertion, the wrong-insertion prohibiting piece sufficiently precludes the terminal from inserting into the connector housing, so that the inverse insertion can be prevented from occurring, with the result that the protection for the elastic contact piece is capable of being attained.

Further, the elastic contact piece consists of a spring piece formed to be curved rearward and elongated toward a front end of the bottom wall.

As stated above, since the elastic contact piece consists of the spring piece formed to be curved rearward and elongated toward a front end of the bottom wall, the elasticity of the elastic contact piece is capable of being sufficiently increased.

Furthermore, at least a part of the terminal body section has a box-sectional-shape, and a pointed end of the elastic contact piece consisting of the spring piece formed to be curved is protruded toward the outside direction of the box-sectional-shape portion.

As stated above, when the elastic contact piece is greatly bent, it comes into contact with the box-sectional-portion, thereby the excessive deflection and the permanent set in fatigue of the elastic contact piece are prevented from occurring.

Moreover, openings formed due to providing the slitting-and-forming piece become lance fitting holes for fitting the lance at the connector housing side.

As stated above, when the terminal is inserted into the terminal insertion hole, the lance at the side of the connector housing can engage with the lance fitting hole, thereby omission of the terminal is prevented. The wrong-insertion prohibiting piece and the lance fitting hole are formed simultaneously.

The above and further objects and novel features of the invention will be more fully understood from the following detailed description when the same is read in connection with the accompanying drawings. It should be expressly understood, however, that the drawings are for purpose of illustration only and are not intended as a definition of the limits of the invention.

BRIEF DESCRIPTION OF THE DRAWINGS

FIG. 5A is a constructive view showing a reverse side surface of terminal as a comparative example, FIG. 5B is an elevation view showing a condition when attempting to insert the terminal into the terminal insertion hole of the connector housing in the inverse direction;

FIG. 6A a constructive view showing a reverse side surface of the terminal as a comparative example, FIG. 6B is an elevation view showing a condition when attempting to insert the terminal into the terminal insertion hole of the connector housing in the normal direction.

DETAILED DESCRIPTION OF THE PREFERRED EMBODIMENTS

A preferred embodiment of the present invention will now be described in detail referring to the accompanying drawings.

Figure 1:
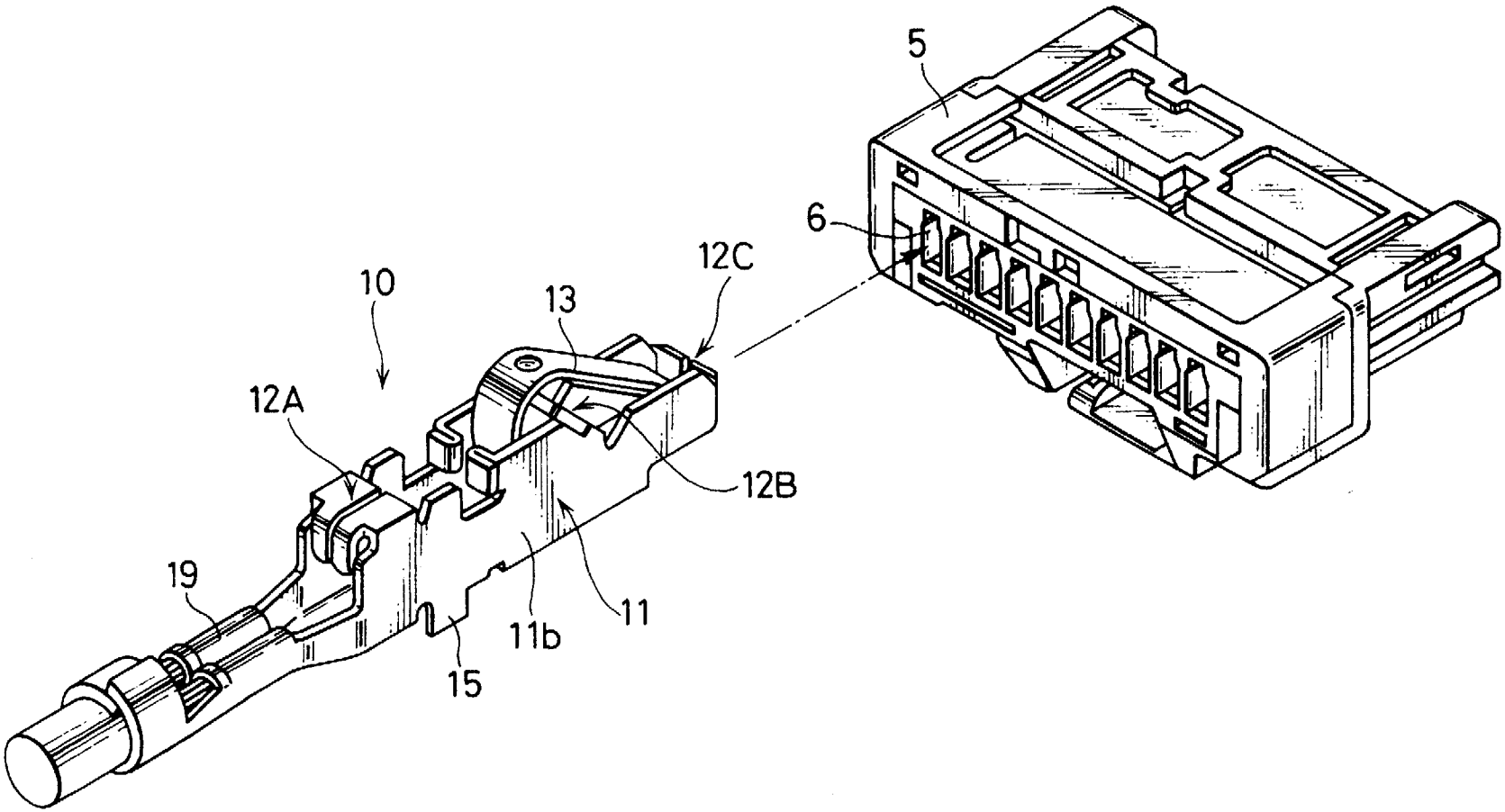
FIG. 1 is a perspective view showing a relation between a terminal for an electrical connector and a connector housing of one embodiment according to the present invention.

FIG. 1 shows a terminal for an electrical connector 10 which is formed in such a way that a metallic plate is stamped out by metallic mold and then being shaped to be crooked or to be curved, and a connector housing 5.

The terminal for the electrical connector (hereinafter represented as terminal) 10 comprises a cylindrical terminal body section 11, an elastic contact piece 13 formed in front thereof, a wrong-insertion prohibiting piece 15 protruded in the outer direction from the terminal body section 11, and a wire staking section 19 formed at rear section of the terminal body section 11. The terminal body section 11 is shaped such as C-shape (semi-cylindrical shape) in a cross section in such a way that a metal plate is stamped out by the press and then is bent in the width direction, consisting of a bottom wall 11*a* and both side walls 11*b*, 11*b*.

Box-shaped-section-parts 12A, 12B are formed in such a way that the upper ends of side walls 11*b*, 11*b* are bent inward to be put opposite with each other at two points in the longitudinal direction of the terminal body section 11. Further, the side walls 11*b*, 11*b* are bent inward to be put opposite with each other at the pointed end 12C of the terminal body section 11. Due to these construction, the terminal body section 11 is formed roughly in the shape of a box.

The elastic contact piece 13 is protruded in the outside direction of the terminal body section 11 so that the elastic contact piece 13 comes into contact with the inner peripheral wall of the terminal insertion hole 6 when inserting the terminal body section 11 into the terminal insertion hole 6 of the connector housing 5. The elastic contact piece 13 consists of a spring piece formed to be curved rearward with regard to a long strip of board elongated toward the front end of the bottom wall 11*a* of the terminal body section 11. The pointed end side of the terminal body section 11 is additionally curved toward the terminal body section 11 at the outside of the box-shaped-section-part 12B.

Consequently, the box-shaped-section-part 12B fulfills its function as a preventing section for a permanent set in fatigue which preventing section regulates the deflection of the elastic contact piece 13.

Figure 2:
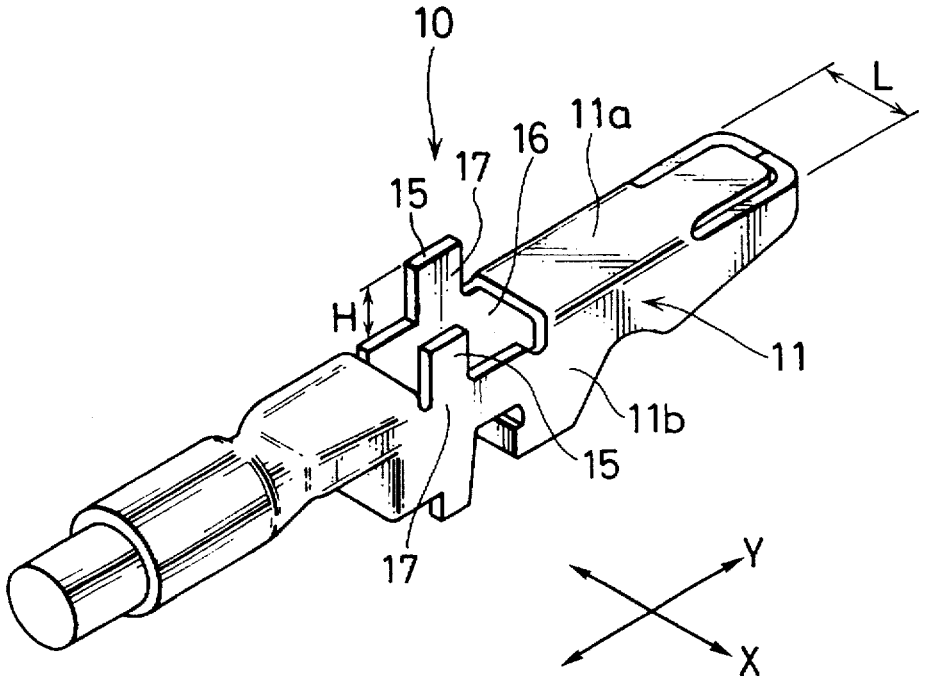
FIG. 2 is a perspective view showing a construction of the reverse side surface of the terminal for the electrical connector of the embodiment.

FIG. 2 shows a construction of rear surface of the terminal 10.

Two pieces of the wrong-insertion prohibiting pieces 15 are positioned on both end edges in the width direction (in the direction of an arrow X) of the bottom wall 11*a*, and at an intermediate section of the longitudinal direction of the bottom wall 11*a* of the terminal body section 11. These wrong-insertion prohibiting pieces 15 are formed as the notched pieces of the bottom wall 11*a*, which are arranged at shifted positions in the longitudinal direction (in the direction of an arrow Y) of the terminal body section 11. It can be established a height H of the wrong-insertion prohibiting piece 15 within maximum dimension to be taken in the width dimension L of the bottom wall 11*a* (H is approximately equal to L) due to the fact that the arrangement of two pieces of the wrong-insertion prohibiting pieces 15 are shifted in the longitudinal direction.

In this case, the following construction of two pieces of the wrong-insertion prohibiting pieces 15, 15 is introduced.

Figure 3:
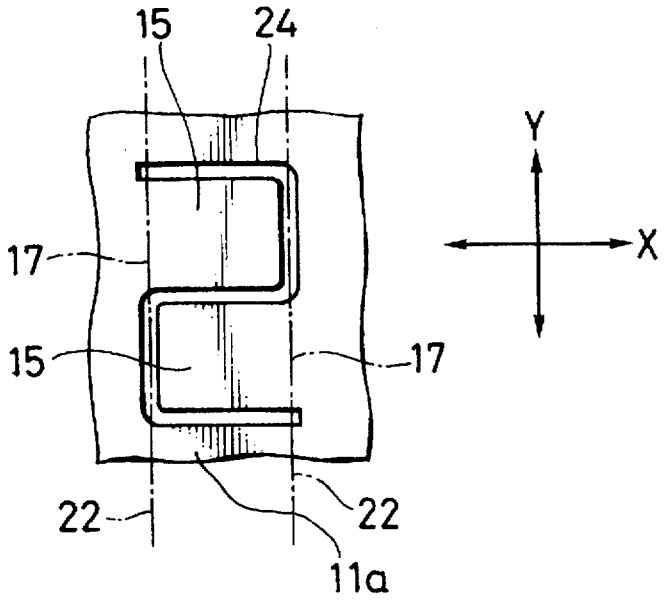
FIG. 3 is an exploded view showing a circumferential section of a wrong-insertion prohibiting piece of the terminal for the electrical connector of the embodiment.

Namely, as shown in development of principal portion of FIG. 3, a cut 24 shaped as counter-S-shape (or S-shape) is slitted, and the coupling section is established at the position of each bending lines 22, 22. The cut 24 is provided at the board material. It causes the bending lines 22, 22 as the boundary line (corresponding to the both end edges in the width direction of X) to adopt as reference line. Two pieces of the wrong-insertion prohibiting pieces 15, 15 are formed at shifted position in the longitudinal direction of the terminal in that it causes each inside-piece (a part surrounded by cut) of the cut 24 to cut to be raised toward the outer direction by employing each bending reference points 17 (being roughly consistent with the position of the bending line 22) as the fulcrum, which reference points 17 are established on both side edges of the width direction (in the direction of arrow Y) of the bottom wall.

Openings which are formed by cutting to be raised the wrong-insertion prohibiting pieces 15, 15 becomes lance fitting hole for fitting the lance at the connector housing side.

Figure 4:
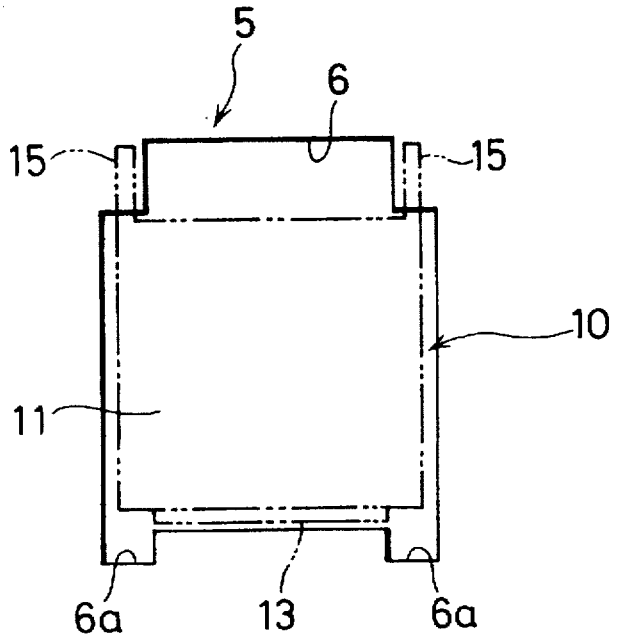
FIG. 4 is an elevation view showing a condition attempting to insert the terminal for the electrical connector into the terminal insertion hole of the connector housing in the inverse direction.

In the terminal for electrical connector 10, the wrong-insertion prohibiting pieces 15 are each provided on both end edges of the width direction of the bottom wall 11*a*, and since establishing those protruded height H to be the same numeral value as the width dimension L of the bottom wall 11*a*, as shown in FIG. 4, when the terminal 10 is inserted into the terminal insertion hole 6, a precluding margin (catching margin) in the inverse direction, can largely be obtained without upsetting the balance of the terminal 10. Consequently, even if the elastic contact piece 13 is bent to some extent at the time of inverse insertion, the wrong-insertion prohibiting piece 15 sufficiently precludes the terminal from inserting into the terminal insertion hole of the connector housing 5, so that the inverse insertion can be prevented from occurring, with the result that the protection for the elastic contact piece 13 is capable of being attained.

The terminal 10 can be inserted into the terminal insertion hole 6 without interference with the connector housing 5 since when the terminal 10 is inserted into the terminal insertion hole 6 in the normal direction, the wrong-insertion prohibiting piece 15 is inserted into the groove 6*a* of the terminal insertion hole 6. When the terminal 10 is inserted into the terminal insertion hole 6, the lance (not illustrated) at the side of the connector housing 5 can engage with the lance fitting hole 16, thereby omission of the terminal 10 is prevented.

With regard to the terminal 10, the elastic contact piece 13 which causes the opposite terminal to come into slidingly contact therewith is constituted by the spring piece being curved rearward and elongated toward the front end of the bottom wall 11*a*. For this reason, the elastic contact piece 13 can have large elasticity. A slidable contact property with regard to the opposite terminal becomes good so that improvement of the electrical connecting characteristic is capable of being attained.

Next, comparative example to the present invention will be described.

Figure 5A:
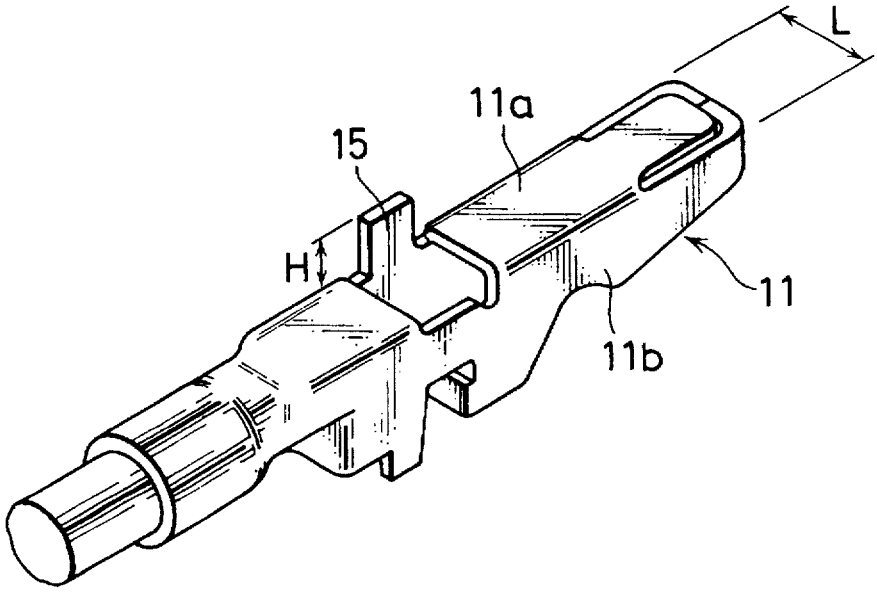
FIGS. 5A to 5B are the first comparative examples to the embodiment.
Figure 5B:
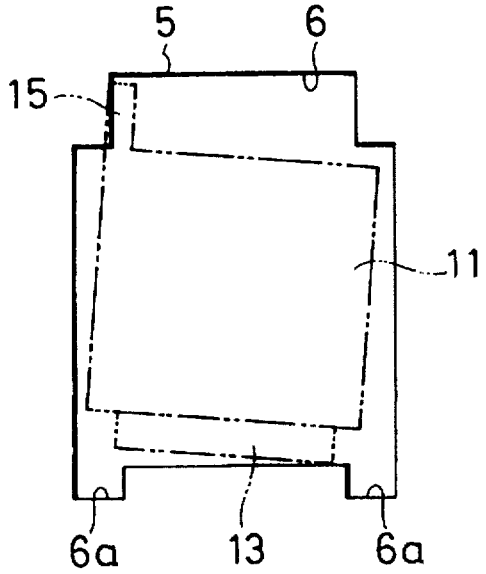

FIGS. 5A and 5B show the case where only one piece of wrong-insertion prohibiting piece is provided. In this case, as shown in FIG. 5A, the height H of the wrong-insertion prohibiting piece 15 can be established to the degree corresponding to the width dimension L of the bottom wall 11*a* similar to the above embodiment. However, as shown in FIG. 5B, since the wrong-insertion prohibiting piece 15 is arranged at only one side thereof, when the terminal is inserted into the terminal insertion hole 6 of the connector housing 5, the terminal 10 has an inclination to upset the balance. When the terminal 10 upsets the balance, the precluding margin between the wrong-insertion prohibiting piece 15 and the connector housing 5 is missing, so that it is feared that the inverse insertion can not be prevented.

Figure 6A:
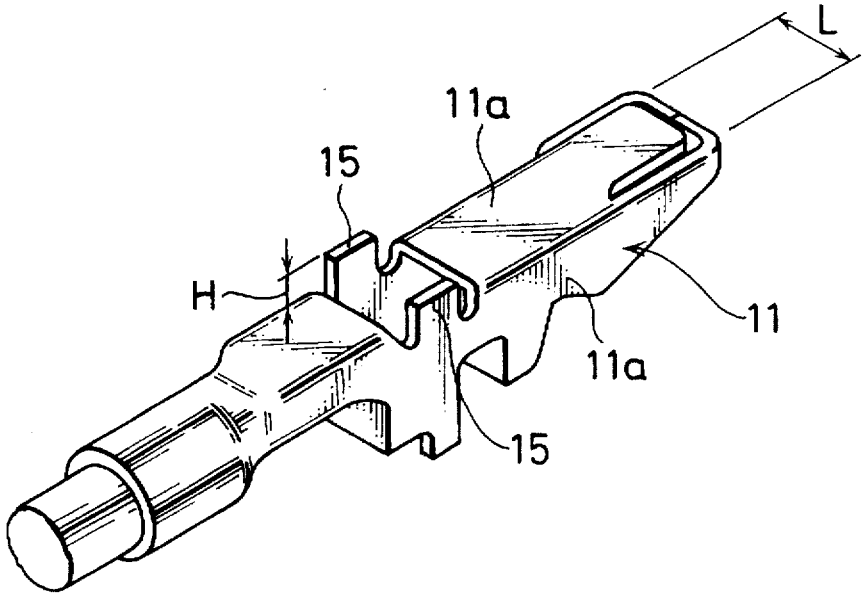
FIGS. 6A to 6B are the second comparative embodiment to the embodiment.
Figure 6B:
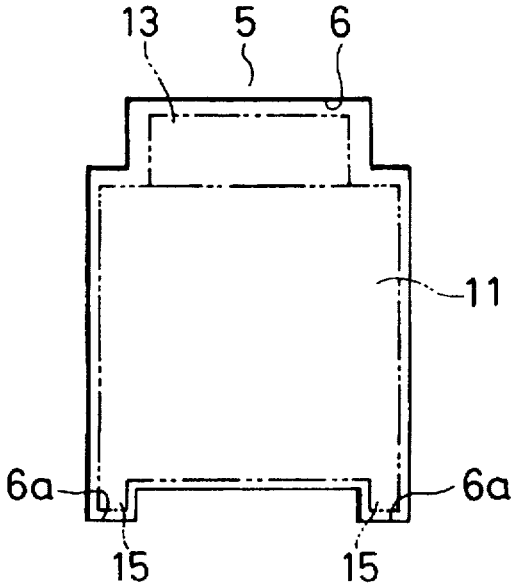
Figure 6C:
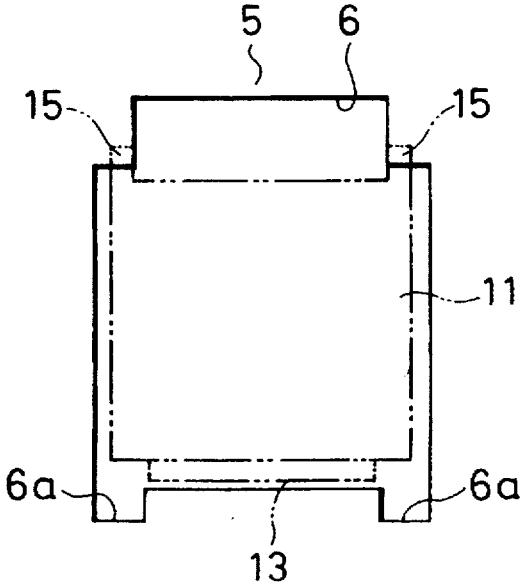
FIG. 6C is an elevation view showing a condition when attempting to insert the terminal into the terminal insertion hole of the connector housing in the inverse direction.

FIGS. 6A, 6B, and 6C show the case where two wrong-insertion prohibiting pieces are provided. Since these positions are provided in the same position with regard to the longitudinal direction, as shown in FIG. 6A, the protruded height H of the wrong-insertion prohibiting piece 15 can only be established to the extent of half of the width dimension L of the bottom wall 11*a*. Consequently, as shown in FIG. 6B, there would be no problem when the terminal 10 is inserted into the terminal insertion hole 6 in the normal direction. As shown in FIG. 6C, when the terminal 10 is inserted into the terminal insertion hole 10 in the inverse direction, since it can not be ensured the precluding margin, so that it is feared that the inverse insertion can not be prevented.

As stated above, according to the present invention, since two pieces of the wrong-insertion prohibiting pieces 15, 15 are arranged to be shifted in the longitudinal direction, secure preventing effect with regard to the inverse-insertion of the terminal can be obtained.

While preferred embodiments of the present invention have been described using specific terms, such description is for illustrative purpose only, and it is to be understood that changes and variations may be made without departing from the spirit or scope of the following claims.

What is claimed is:

1. A terminal for an electrical connector comprising:

a terminal body section provided by bending a metallic plate material in a generally semi-cylindrical shape;

an elastic contact piece formed so as to protrude from a front section of said terminal body section to the outside; and two wrong-insertion prohibiting pieces formed so as to project from a bottom wall of said terminal body section in a direction opposite to said elastic contact piece, said two wrong-insertion prohibiting pieces being arranged on both edges of said bottom wall in a width direction of said terminal body section respectively, and shifted from each other in a longitudinal direction of said terminal body section;

wherein said two wrong-insertion prohibiting pieces are provided by slitting said bottom wall of said terminal body section partially and raising the two resultant slitted portions of said bottom wall in a direction perpendicular to said bottom wall.

2. A terminal for an electrical connector according to claim 1, wherein said elastic contact piece consists of a curved spring piece.

3. A terminal for an electrical connector according to claim 2, wherein at least a part of said terminal body section is generally box-shaped, and an end of said elastic contact piece protrudes from said generally box-shaped terminal body section.

4. A terminal for an electrical connector according to claim 1, wherein said wrong-insertion prohibiting pieces each have a height H and are spaced apart by a width L, wherein H is generally equal to L.

5. A terminal for an electric connector comprising:

a terminal body section having a generally semi-cylindrical shape defining an axis;

an elastic contact piece protruding from a front section of said terminal body section, for coming into contact with an inner peripheral wall of a terminal insertion hole when said terminal body section is inserted into the terminal insertion hole of a connector housing; and a wrong-insertion prohibiting portion projecting from a bottom wall of said terminal body section, positioned at an opposite side of said terminal body section from said elastic contact piece, for preventing said terminal from inserting into the terminal insertion hole in an inverse direction, said wrong-insertion prohibiting portion comprising first and second wrong-insertion prohibiting pieces projecting from said terminal body section on opposite sides of said axis and spaced apart from one another with respect to a line normal to said axis.

* * * * *